United States Patent [19]

Yamaguchi et al.

[11] Patent Number: 4,487,704

[45] **Date of Patent: * Dec. 11, 1984**

[54] LUBRICATING OIL COMPOSITIONS CONTAINING AN OVERBASED CALCIUM SULFONATE AND A ZINC CYCLIC HYDROCARBYL DITHIOPHOSPHATE-SUCCINIMIDE COMPLEX

[75] Inventors: Elaine S. Yamaguchi, El Cerrito; Thomas V. Liston, San Rafael, both of Calif.

[73] Assignee: Chevron Research Company, San Francisco, Calif.

[ * ] Notice: The portion of the term of this patent subsequent to Apr. 17, 2001 has been disclaimed.

[21] Appl. No.: 443,362

[22] Filed: Nov. 22, 1982

[51] Int. Cl.[3] ..... C10M 1/48

[52] U.S. Cl. ..... 252/33.4

[58] Field of Search ..... 252/32.7 E, 46.7, 389 A, 252/400 A, 33.4; 260/429.9

[56] References Cited

U.S. PATENT DOCUMENTS

| | | | |
|---|---|---|---|
| 3,089,850 | 5/1963 | McConnell et al. | 252/32.7 E |
| 3,135,694 | 6/1964 | Loughran et al. | 252/32.7 E X |
| 3,284,354 | 11/1966 | Tunkel et al. | 252/32.7 E |
| 3,502,677 | 3/1970 | LeSuer | 252/32.7 E X |
| 3,652,616 | 3/1972 | Watson et al. | 252/46.7 X |
| 3,844,960 | 10/1974 | Breitigam et al. | 252/32.7 E |
| 3,846,317 | 11/1974 | Lintzenich | 252/46.7 |
| 4,306,984 | 12/1981 | Yamaguchi | 252/32.7 E X |
| 4,443,360 | 4/1984 | Yamaguchi et al. | 252/46.7 |

FOREIGN PATENT DOCUMENTS

| | | | |
|---|---|---|---|
| 1237581 | 6/1971 | United Kingdom | 252/32.7 E |

*Primary Examiner*—Andrew Metz

*Attorney, Agent, or Firm*—S. R. LaPaglia; J. M. Whitney; G. F. Swiss

[57] ABSTRACT

The anti-wear properties of lubricating oil compositions containing overbased calcium sulfonate are improved when a complex of a zinc salt of a cyclic hydrocarbyl dithiophosphoric acid of 2,4-pentanediol and a succinimide is added to the oil. Oil compositions containing this combination are useful as crankcase lubricants.

7 Claims, No Drawings

LUBRICATING OIL COMPOSITIONS CONTAINING AN OVERBASED CALCIUM SULFONATE AND A ZINC CYCLIC HYDROCARBYL DITHIOPHOSPHATE-SUCCINIMIDE COMPLEX

BACKGROUND OF THE INVENTION

1. Field of the Invention

This invention relates to a lubricating oil composition which reduces wear between relatively moving surfaces while providing protection, concomitantly from sludge formation and corrosion.

2. Description of the Prior Art

A balanced formulated lubricating oil for use in an internal combustion engine normally contains additives which will protect against wear, act as antioxidants, corrosion inhibitors and detergent-dispersants.

In the past many hydrocarbyl dithiophosphate compounds have been employed as additives in lubricant compositions primarily to reduce wear and to act as antioxidants. Of the many compounds employed, perhaps the best known are zinc salts of O,O'-dihydrocarbyl dithiophosphoric acids.

Also, since lubricating oils tend to deteriorate under conditions of use in the present day automobile engine, with the attendant formation of sludge, lacquer and resinous materials, it is common to add agents which are known in the art as detergents, dispersants or detergent-dispersants. Overbased metal hydrocarbyl sulfonates are particularly useful in this respect. These agents are believed to be effective because they provide alkalinity capable of neutralizing strong organic and inorganic acids and are capable of dispersing deposits and deposit precursors into the oil phase.

It has been found, however, that lubricating oils containing overbased calcium hydrocarbyl sulfonates tend to offset the effectiveness of the normal metal salts of dihydrocarbyl dithiophosphoric acids to provide sufficient wear protection in the internal combustion engine of an automobile. This is an especially bad situation at this time since automobile manufacturers are seeking to use lower levels of metal salts of dihydrocarbyl dithiophosphoric acids in lubricating oils in order to protect against deterioration in performance of the emissions control system—both catalyst poisoning and oxygen sensor contamination are involved.

SUMMARY OF THE INVENTION

It has now been found that this detrimental effect of the overbased calcium hydrocarbyl sulfonates on wear of metal parts in the internal combustion engine can be overcome by adding to a lubricating oil containing these materials an effective amount to reduce wear of a complex prepared by reacting at about 25° C. to 180° C.:

(a) a zinc salt of a cyclic dihydrocarbyl dithiophosphoric acid of the formula

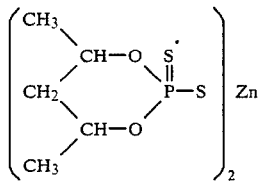

I with (b) an oil soluble alkenyl or alkyl mono- or bis-succinimide of the formula

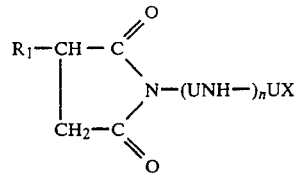

wherein X is amino or a group of the formula

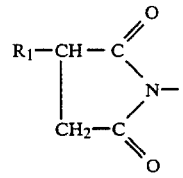

$R_1$ is an alkenyl or alkyl group containing from about 20 to 300 carbon atoms, U is alkylene containing 2 to 6 carbon atoms, n is an integer of from 0 to 6; wherein the weight of ratio of (b) to (a) is at least in the range of from 3:1 to 25:1, preferably 3:1 to 10:1.

DETAILED DESCRIPTION

The oil soluble complexes of the formula I prepared from the zinc cyclic hydrocarbyl dithiophosphate of 2,4-pentanediol and an alkenyl or alkyl mono- or bis-succinimide useful in the present invention, are described in copending U.S. application Ser. No. 369,706, filed Apr. 18, 1982, the disclosure of which is incorporated totally herein by reference.

The complex, the exact structure of which is not known, may be formed by reacting the zinc cyclic hydrocarbyl dithiophosphate of 2,4-pentanediol and the succinimide together in a diluent in which both reactants are soluble. For example, the reactants may be combined in the proper ratio in a solvent such as toluene or chloroform, the solvent stripped off, and the complex thus formed may be added to the oil or the oil may be added prior to solvent stripping, i.e., the oil is added to the solvent-complex solution and the solvent subsequently stripped.

The diluent is preferably inert to the reactants and products formed and is used in an amount sufficient to insure solubility of the reactants and to enable the mixture to be efficiently stirred.

Temperatures for preparing the complex may be in the range of from 25° C. to 200° C. and preferably 25° C. to 80° C. Since the zinc cyclic hydrocarbyl dithiophosphonate of 2,4-pentanediol is essentially insoluble in oil, the complex may not be made in-situ in the oil, e.g., addition of the insoluble zinc cyclic hydrocarbyl dithiophosphate to an oil containing the appropriate ratio of a succinimide does not solubilize the dithiophosphate.

Alternately, the soluble cyclic hydrocarbyl zinc dithiophosphate-succinimide complex used in this invention is prepared by reacting cyclic hydrocarbyl dithiophosphoric acid of 2,4-pentanediol with the basic zinc compound and the oil-soluble alkenyl or alkyl mono- or bis-succinimide in an organic solvent.

In carrying out this process, the cyclic hydrocarbyl dithiophosphoric acid is added to a slurry containing a basic zinc compound and the succinimide in an organic hydrocarbon solvent. The components are reacted at a temperature of about 25° C. to 180° C. A promoter such as water or acetic acid may also be used to assist the reaction.

Preferably, the temperature is adjusted in order to azeotrope off any water formed during the course of the reaction, i.e., 80° C. to 140° C.

Typical examples of solvents which may be used include benzene, toluene, xylene, and the like.

Sufficient basic zinc compound is present to essentially neutralize the cyclic hydrocarbyl dithiophosphoric acid of 2,4-pentanediol and is present in the reaction mixture in an amount of from about 0.7 to 1.3 equivalents per equivalent of the cyclic hydrocarbyl dithiophosphoric acid. Preferably, the basic zinc compound and the cyclic hydrocarbyl dithiophosphoric acid are present in an equivalent amount.

Weight percent ratios of alkenyl or alkyl mono- or bis-succinimides to zinc cyclic hydrocarbyl dithiophosphate in the complex in the range of 3:1 to 25:1 and preferably from 3:1 to 10:1 should be maintained. Lesser amounts of the succinimide will result in haziness and precipitation of the zinc cyclic hydrocarbyl dithiophosphate of 2,4-pentanediol.

The cyclic hydrocarbyl zinc dithiophosphate may be prepared by the reaction of 2,4-pentanediol with phosphorus pentasulfide followed by reaction with a basic zinc compound such as zinc oxide, hydroxide, carbonate and the like. Methods for preparing this compound are described in U.S. Pat. No. 3,089,850, and the disclosures thereof are incorporated herein by reference.

The oil soluble alkenyl or alkyl mono- or bis-succinimides which are employed in preparing the oil soluble complexes are generally known as lubricating oil dispersants and are described in U.S. Pat. Nos. 2,992,708, 3,018,291, 3,024,237, 3,100,673, 3,219,666, 3,172,892 and 3,272,746, the disclosure of which are incorporated by reference. These materials are prepared by reacting an alkenyl or alkyl-substituted succinic anhydride of the formula:

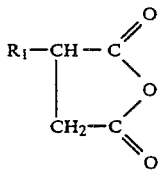

wherein $R_1$ is defined above, with a polyalkylenepolyamine of the formula:

$$H_2N—UNH_nUNH_2$$

wherein U and n are defined above.

The alkylene group designated by U, which contains from 2 to 6 carbon atoms, may be straight chain or branched, but will usually be straight chained. Illustrative alkylene groups are ethylene, propylene, 1,2-propylene, tetramethylene, hexamethylene, etc. The preferred alkylene groups are from two to three carbon atoms, there being two carbon atoms between the nitrogen atoms.

Non-limiting examples of suitable amine compounds include: 1,2-diaminoethane; 1,3-diaminopropane; 1,4-diaminobutane; 1,6-diaminohexane; diethylene triamine; triethylene tetramine, tetraethylene pentamine; 1,2-propylene diamine; and the like.

A product comprising predominantly of mono- or bis-succinimide can be prepared by controlling the molar ratios of the reactants. Thus, for example, if one mole of amine is reacted with one mole of the alkenyl or alkyl substituted succinic anhydride, a predominantly mono-succinimide product will be prepared. If two moles of the succinic anhydride are reacted per mole of polyamine, a bis-succinimide will be prepared.

The preparation of the alkenyl substituted succinic anhydride by reaction with a polyolefin and maleic anhydride has been described, e.g., U.S. Pat. Nos. 3,018,250 and 3,024,195. Reduction of the alkenyl substituted succinic anhydride yields the corresponding alkyl derivative. Polyolefin polymers for reaction with the maleic anhydride are polymers comprising a major amount of $C_2$ to $C_5$ mono-olefin, e.g., ethylene, propylene, butylene, isobutylene and pentene. The polymers can be homopolymers such as polyisobutylene as well as copolymers of two or more such olefins such as copolymers of: ethylene and propylene; butylene and isobutylene; etc. Other copolymers include those in which a minor amount of the copolymer monomers, e.g., 1 to 20 mole % is a $C_4$ to $C_8$ nonconjugated diolefin, e.g., a copolymer of isobutylene and butadiene or a copolymer of ethylene, propylene and 1,4-hexadiene; etc.

The olefin polymers contain from about 20 to 300 carbon atoms and preferably from 30 to 150 carbon atoms. An especially preferred polyolefin is polyisobutylene.

The additive complex is generally present in a lubricating oil at a concentration of about 0.05 to about 10 weight percent, preferably about 1.5 to about 6 weight percent.

The overbased calcium hydrocarbyl sulfonates are materials well known in the art and are commercially available materials.

Oil soluble overbased calcium hydrocarbyl sulfonates are made by reacting a calcium base with oil-soluble hydrocarbyl sulfonic acids. Suitable oil-soluble sulfonic acids can be aliphatic or aromatic compounds. Suitable aromatic sulfonic acids are the oil-soluble petroleum sulfonic acids, commonly referred to as "mahogany acids", aryl sulfonic acids, and alkaryl sulfonic acids. Illustrative of such sulfonic acids are dilauryl benzene sulfonic acid, lauryl cetyl benzene sulfonic acid, paraffin-substituted benzene sulfonic acids, polyolefin alkylated benzene sulfonic acids, such as polybutylene alkylated benzene sulfonic acids in which the polybutylene substituents have a molecular weight of at least about 100, and preferably within the range of from about 100 to about 10,000, and polypropylene alkylated benzene sulfonic acids in which the polypropylene substituents have a molecular weight of at least about 80 and preferably within the range of from about 80 to about 10,000. Examples of other suitable sulfonic acids are diparaffin wax-substituted phenol sulfonic acids, acetyl chlorobenzene sulfonic acids, cetyl-phenol disulfide sulfonic acids, cetyl-phenol monosulfide sulfonic acids, and cetoxy capryl benzene sulfonic acids. Other suitable oil-soluble sulfonic acids are well described in the art, such as for example U.S. Pat. No. 2,616,604; U.S. Pat. No. 2,626,207; and U.S. Pat. No. 2,767,209, and others.

Some calcium salts of the above compounds have the general formula:

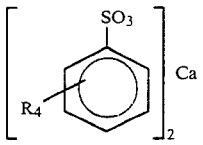

where $R_4$ is alkyl or hydroxy, chloro or bromo hydrocarbyl. In some cases the R group can be made by polymerizing $C_2$–$C_6$ olefins to a molecular weight in the range of about 80 to about 10,000, preferably about 80 to about 1,000, and then attaching said group to a benzene ring by well-known alkylation techniques. $R_4$ can be most any hydrocarbon or substituted hydrocarbon which results in an oil soluble benzene sulfonic acid or salt thereof. $R_4$ can be a low molecular weight alkyl such as isobutyl, nonyl, dodecyl, and the like; an intermediate molecular weight hydrocarbyl such as $C_{15}$–$C_{100}$ polybutene or polypropylene polymers; a higher molecular weight hydrocarbyl such as polyolefin having a number average molecular weight of 10,000, and others. $R_4$ can be substituted with groups such as chlorine, bromine, hydroxy, nitro, or sulfonic acid groups. Also, the benzene ring of the sulfonic acid may have more than one substituent alkyl, or hydroxy, halo, nitro or sulfonic acid alkyl groups.

Nonaromatic sulfonic acids are generally made by the sulfonation of most any aliphatic hydrocarbon such as alkanes, alkenes, and the like. Also, the hydrocarbyl may contain various substitutions which do not interfere with later reactions or end use. One preferred group of non-aromatic sulfonic acids is made by the sulfonation of polymers or copolymers, such as polymerized or copolymerized olefins.

The term polymer olefins as used herein refers to amorphous polymers and copolymers derived from olefinically unsaturated monomers. Such olefin monomers include olefins of the general formula $R_5CH{=}CH_2$, in which $R_5$ comprise aliphatic or cycloaliphatic radical of from 1 to about 20 carbon atoms, for example, propene, isobutylene, butene-1, 4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1,7-octadiene, etc. These polyolefins have a number average molecular weights from about 36 to about 10,000 or higher, but preferably from about 80 to about 10,000. Of these materials, a preferred group is polypropylene or polybutylene polymers. The olefin may be a copolymer, such as an ethylene propylene copolymer or ethylene-propylenehexadiene terpolymer, or others.

The preparation of the sulfonic acids is well known. Such sulfonic acids can be prepared by reacting the material to be sulfonated with a suitable sulfonating agent, such as concentrated sulfuric acid, fuming sulfuric acid, chlorosulfonic acid or sulfur trioxide for a period of time sufficient to effect sulfonation, and thereafter separating insoluble acid sludge from the oil soluble sulfonic acid. Overbased sulfonates are commonly made by the reaction of sulfonic acid with calcium bases such as the oxide, hydroxide, or carbonate. Suitable processes for making overbased sulfonates are described in U.S. Pat. Nos. 3,126,340; 3,492,230; 3,524,814 and 3,609,076. The carbonate overbased calcium sulfonates are preferably made from CaO and carbon dioxide in the presence of a promotor such as ethylene diamine or ammonia. However, some overbased sulfonates contain no carbonate.

The term "overbased" as used herein refers to sulfonate materials having a neutralization number greater than about 100, preferably greater than 300, as determined by ASTM D-664 or D-2896.

One of the preferred overbased calcium hydrocarbyl sulfonates comprises overbased alkyl benzene sulfonate comprising about 4 to about 100 carbon atoms in the alkyl group, and having a total base number from about 100 to about 500 and a calcium content in the range of about 3% to 18% by weight.

The overbased calcium sulfonates are generally present in a lubricating oil at a concentration of about 0.05% to 5% by weight and preferably about 0.2 to about 2% by weight.

Additive concentrates are also included within the scope of this invention. They usually include from about 90 to 10 weight percent of an oil of lubricating viscosity and are normally formulated to have about 10 times the additive concentration that would be used in the finished lubricating oil composition. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although any oil of lubricating viscosity can be used.

Suitable lubricating oils which can be used to prepare lubricating oil compositions or concentrates of this invention are oils of lubricating viscosity derived from petroleum or synthetic sources. The oils can be paraffinic, naphthenic, halo-substituted hydrocarbons, synthetic esters, polyolefins or combinations thereof. Oils of lubricating viscosity have viscosities in the range from 35 to 50,000 SUS at 100° F., and more usually from about 50 to 10,000 SUS at 100° F.

Other conventional additives which may also be used in combination with the additive combination of this invention include oxidation inhibitors, antifoam agents, rust and corrosion inhibiting agents, viscosity index improvers, pour-point depressants, and the like. These include such compositions as chlorinated wax, benzyl disulfide, sulfurized sperm oils, sulfurized terpene, phosphorus esters such as trihydrocarbon phosphites, metal thiocarbamates such as zinc dioctyldithiocarbamate, polyisobutylene having an average molecular weight of 100,000, etc.

The lubricating oil compositions of the invention are especially useful for lubricating internal combustion engines.

EXAMPLES

The following examples are provided to illustrate the invention. It is to be understood that they are provided for the sake of illustration only and not as a limitation on the scope of the invention.

EXAMPLE 1

To a 2-liter, 3-necked flask equipped with a stirrer, nitrogen inlet, dropping funnel and condenser containing 600 ml of toluene and 222 gm (1.0 mole) of $P_2S_5$ was added 208.3 gm (2.0 mole) of 2,4-pentanediol over a period of 25 minutes. The temperature rose to 43° C. with a large volume of $H_2S$ evolving. After stirring the reaction mixture under nitrogen for 0.5 hour, the reaction mixture was heated to reflux for about 2 hours. The reaction mixture was then filtered and the filtrate stripped of solvent in a Rotary Evaporator under full pump vacuum and a water-bath temperature up to 80° C. The product, a greenish-yellow oily liquid, weighed 384.5 gm. Acid number of product was 249; 239 mg KOH/gm and $^{31}$PNMR confirmed the cyclic nature of the product having the formula:

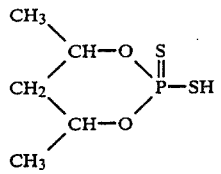

In a similar manner, the cyclic hydrocarbyl dithiophosphoric acid from neopentyl glycol was prepared by substituting an equivalent amount of the neopentyl glycol for the 2,4-pentanediol in the above reaction.

EXAMPLE 2

To a 2-liter, 3-necked flask equipped with a stirrer, nitrogen inlet, dropping funnel and Dean-Stark trap containing 480 ml toluene, 495 gm of polyisobutenyl succinimide (prepared by reacting polyisobutenyl succinic anhydride and triethylene-tetramine wherein the number average molecular weight of the polyisobutenyl was about 940 and in a mole ratio of amine to anhydride of 0.90) and 20.34 gm (0.25 mole) of zinc oxide at a temperature of 50° C. was added 115 gm (0.5 mole) of the cyclic hydrocarbyl dithiophosphoric acid of 2,4-pentanediol of Example 1 over a period of 45 minutes. The temperature was elevated to about 75° C. and maintained for 3.5 hours after which the temperature was raised to reflux for 1.5 hours. The reaction mixture was cooled, diluted with 200 ml toluene, heated to 50° C. and filtered. The clear filtrate was stripped in a Rotary Evaporator under a full pump vacuum and a water-bath temperature up to 82° C. to yield zinc cyclic hydrocarbyl dithiophosphate of 2,4-pentanediol-succinimide complex.

In a similar manner, the zinc cyclic hydrocarbyl dithiophosphate neopentyl glycol-succinimide complex was prepared by substituting an equivalent amount of the cyclic hydrocarbyl dithiophosphoric acid of neopentyl glycol for the cyclic hydrocarbyl dithiophosphoric acid of 2,4-pentanediol in the above procedure.

EXAMPLE 3

Formulated oils containing the additives shown in Table I were prepared and tested in a Sequence V-D Test method Phase 9-L (according to candidate test for ASTM) the results of which are shown in Table II. This procedure utilized a Ford 2.3 liter four cylinder engine. The test method simulates a type of severe field test service characterized by a combination of low speed, low temperature "stop and go" city driving and moderate turnpike operation. The effectiveness of the additives in the oil is measured in terms of the protection provided against valve train wear.

Formulations B and C were prepared by adding each of the succinimide complexes of zinc cyclic hydrocarbyl dithiophosphates of neopentyl glycol and 2,4-pentanediol of Example 2, respectively, and the overbased calcium sulfonate. Each of the succinimide complexes of Example 2 was present in sufficent amount to supply 8.1 mmoles/kg Zn and 3.5% of the succinimide. Formulation A was prepared by adding each of the zinc dithiophosphate, succinimide and overbased calcium sulfonate components directly to the oil. The base oil used for each formulation was Cit-Con 100N/Cit-Con 200N at 55%/45% containing 20 mmoles/kg of overbased calcium polypropylene phenate and 8.5% polymethacrylate VI improver.

TABLE I

TEST OIL FORMULATIONS (mmoles/kg - except where noted)

| COMPONENTS | FORMULATIONS (mmoles/kg - except where noted) A | B | C |
|---|---|---|---|
| Zinc dithiophosphate from sec-butanol and methylisobutylcarbinol | 8.1 | — | — |
| Zinc cyclic hydrocarbyl dithiophosphate of neopentyl glycol | — | 8.1 | — |
| Zinc cyclic hydrocarbyl dithiophosphate of 2,4-pentanediol | — | — | 8.1 |
| Polyisobutenyl succinimide of Example 2 | 3.5% | 3.5% | 3.5% |
| 300 AV overbased calcium alkaryl sulfonate | 30 | 30 | 30 |

TABLE II

SEQUENCE V-D TEST RESULTS

| Formulation | Cam Lobe Wear × $10^{-3}$ SF Spec. Max. (2.5) | SF Spec. Avg. (1.0) |
|---|---|---|
| A | 6.7 | 3.9 |
| B | 4.0 | 3.1 |
| C | 1.1 | 0.8 |

As indicated from the results in Table II, oil formulation C, containing the complex prepared from zinc cyclic hydrocarbyl dithiophosphate of 2,4-pentanediol and the succinimide dispersant gave superior wear performance relative to formulation B containing the succinimide complex prepared from zinc cyclic hydrocarbyl dithiophosphate of neopentyl glycol and formulation A containing a zinc dithiophosphate of higher alcohols.

What is claimed is:

1. In a lubricating oil composition containing an overbased calcium hydrocarbyl sulfonate, the improvement wherein said lubricating oil composition additionally comprises an effective amount to reduce wear of an oil soluble complex prepared by reacting at about 25° C. to 180° C.;

(a) an zinc salt of a cyclic hydrocarbyl dithiophosphoric acid of the formula

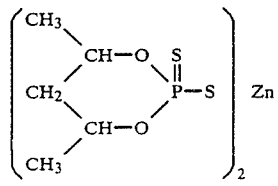

(b) an oil soluble alkenyl or alkyl mono- or bis-succinimide of the formula

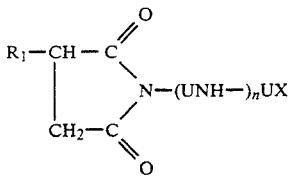

wherein X is amino or a group of the formula

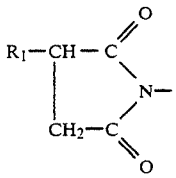

$R_1$ is an alkenyl or alkyl group containing from about 20 to 300 carbon atoms, U is alkylene containing 2 to 6 carbon atoms, n is an integer of from 0 to 6; wherein the weight ratio of (b) to (a) is at least in the range of from 3:1 to 25:1.

2. The composition of claim 1 wherein the complex is present from about 0.01% to 10% by weight based on the total weight of the lubricating oil composition.

3. The composition of claim 1 wherein in said complex, the oil soluble alkenyl or alkyl mono- or bis-succinimide of component (b) is of the formula

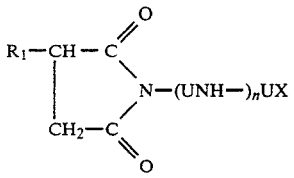

wherein X is amino or a group of the formula

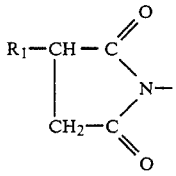

$R_1$ is polyisobutenyl, U is ethylene and n is an integer of from 1 to 4.

4. The composition of claim 3 wherein n is 2.

5. A composition comprising a combination of (1) a complex prepared by reacting at about 25° C. to 180° C.;

(a) a zinc salt of a cyclic hydrocarbyl dithiophosphoric acid of the formula

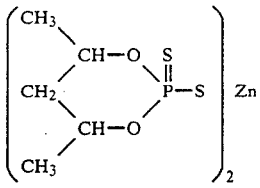

with (b) an oil soluble alkenyl or alkyl mono- or bis-succinimide of the formula

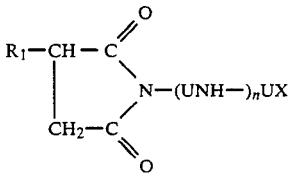

wherein X is amino or a group of the formula

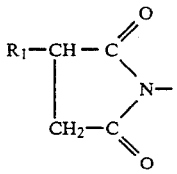

$R_1$ is an alkenyl or alkyl group containing from about 20 to 300 carbon atoms, U is alkylene containing 2 to 6 carbon atoms, n is an integer of from 0 to 6, wherein the weight of ratio of (b) to (a) is at least in the range of from 3:1 to 25:1; and (c) an overbased calcium hydrocarbyl sulfonate, wherein the weight ratio of the complex of component (1) and the overbased calcium salt of component (2) is in the range sufficient to supply from 0.05 to 10% by weight of component (1) and from 0.05 to 5% by weight of component (2) when the additive combination is dissolved in an oil of lubricating viscosity.

6. The composition of claim 5 wherein component 1(b) is of the formula

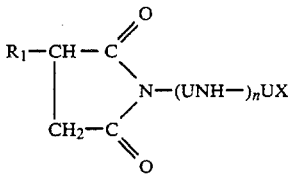

wherein X is amino or a group of the formula

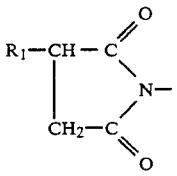

$R_1$ is polyisobutenyl, U is ethylene and n is an integer of from 1 to 4.

7. The composition of claim 6 wherein n is 2.

* * * * *